United States Patent [19]

Shu et al.

[11] Patent Number: 4,598,770

[45] Date of Patent: Jul. 8, 1986

[54] THERMAL RECOVERY METHOD FOR VISCOUS OIL

[75] Inventors: Winston R. Shu, Dallas; Kathy J. Hartman, Arlington, both of Tex.

[73] Assignee: Mobil Oil Corporation, New York, N.Y.

[21] Appl. No.: 664,740

[22] Filed: Oct. 25, 1984

[51] Int. Cl.[4] ..... E21B 43/24

[52] U.S. Cl. ..... 166/245; 166/50; 166/52; 166/272

[58] Field of Search ..... 166/272, 263, 303, 50, 166/52, 245

[56] References Cited

U.S. PATENT DOCUMENTS

| | | | |
|---|---|---|---|
| 4,248,302 | 2/1981 | Churchman | 166/272 |
| 4,296,969 | 10/1981 | Willman | 166/272 X |
| 4,344,485 | 8/1982 | Butler | 166/50 X |
| 4,385,662 | 5/1984 | Mullins et al. | 166/263 |
| 4,434,849 | 3/1984 | Allen | 166/50 X |
| 4,458,758 | 7/1984 | Hunt, III et al. | 166/272 |
| 4,466,485 | 8/1984 | Shu | 166/272 |
| 4,501,326 | 2/1985 | Edmunds | 166/50 X |

OTHER PUBLICATIONS

Oil and Gas Journal, Aug. 23, 1982, pp. 51-54.
SPE Paper 79-30-10, Bezair.
SPE Paper 82-33-68, Pugh.

*Primary Examiner*—Stephen J. Novosad
*Attorney, Agent, or Firm*—A. J. McKillop; Michael G. Gilman; George W. Hager, Jr.

[57] ABSTRACT

A thermal oil recovery process in which steam is injected into a heavy oil-bearing formation through a horizontally-drilled injection well and oil is produced through a horizontal production well parallel to the injection well.

2 Claims, 5 Drawing Figures

VERTICAL HORIZONTAL WELL COMBINATION AT 1290 DAYS

PARALLEL HORIZONTAL WELLS AT 1290 DAYS

VERTICAL WELLS AT 1470 DAYS

THERMAL RECOVERY METHOD FOR VISCOUS OIL

FIELD OF THE INVENTION

This invention relates to a thermal recovery process for recovering viscous oils from subterranean formations. In particular, the invention relates to an improved steam flooding method for recovering such oils.

BACKGROUND OF THE INVENTION

There are many subterranean formations containing heavy, i.e. viscous, oils from which the oil cannot be recovered by conventional methods because the oil is too viscous to flow to the production wells without some form of assistance. Such formations are known to exist in the major tar sand deposits of Alberta, Canada and Venezuela with lesser deposits elsewhere, for example, in California, Utah and Texas. The API gravity of the oils in these deposits typically ranges from 10° to 6° in the Athabasca, Alta. deposits to even lower values in the San Miguel sands in Texas, indicating that the oil is of a highly viscous nature.

Various methods have been proposed for recovering the oil in these deposits now that reserves of more easily recovered oils are decreasing, at least in the politically stable areas of the world. These methods include in-situ combustion methods in which part of the oil in the reservoir is burnt by the injection of air or oxygen through an injection well to generate heat so as to reduce the viscosity of the oil and to produce a degree of cracking; the resulting less viscous, cracked oil then acts as a solvent for the heavy oil in place. Solvent recovery techniques have also been proposed, for example in U.S. Pat. Nos. 4,373,585 and 4,293,035, in which a solvent for the heavy oil is injected into the reservoir to form a less viscous solution which can then be recovered by more conventional means. Another technique which has been proposed and used in various forms is steam flooding, in which steam is injected into the formation through an injection well, to heat the formation and, in so doing, to reduce the viscosity of the oil and possibly also, to induce a degree of cracking, resulting in a further reduction in viscosity. Processes of this type can be generally classified as basically of the two well or one well type. In the two well or steam drive type, the steam is injected through an injection well and the injected steam serves to drive the oil towards a separate production well which is located at some horizontal distance (offset) from the injection well. In the one-well or "huff and puff" type operation, a single well is used for both injection and production. The steam is first injected to reduce the viscosity of the oil and to pressurize the formation; after a certain amount of time, steam injection is terminated and the well is turned over to production. A soak period may be allowed to permit the heat to permeate the reservoir to a greater extent before production is initiated in either type of operation. Whether the process is classified as of the one-well or two well types, the well arrangement can, of course, be repeated to cover the field in the manner desired. For example, the two well arrangement may be repeated in regular patterns such as the inverted five spot or inverted seven spot patterns, as described in U.S. Pat. No. 3,927,716. The present method relates basically to the two well type operation, using an injection well or wells and a separate production well or wells at an offset from the injection well.

Horizontally drilled wells have been proposed in various applications, for example, in solvent recovery processes, as described in U.S. Pat. No. 4,385,662 as well as for offshore primary recovery operations as described, for example, in Ocean Industry, June 1984, 35–36 and in certain steam flooding operations mentioned in the Ocean Industry article.

Among the steam flooding operations using horizontal wells are the Kern River, California "huff and puff" project described in the Oil and Gas Journal, 23 August 1982, 51–54, this project also including conventional vertical steam injection wells bisecting the lateral wells. The Cold Lake, Alta. project which used horizontal wells is believed to be of the single well ("huff and puff") type also; the project has been described in Paper No. 79-30-10 of the Petroleum Society of CIM, presented in Banff, Alta. 8–11 May 1979. A similar project was operated at Fort McMurray, Alta, as described in Paper No. 82-33-68 of the Petroleum Society of CIM, presented 6–9 June 1982 in Calgary, Alta., Petroleum Engineer International, September 1982, 40–52. In addition, U.S. Pat. No. 4,248,302 discloses a steam flood recovery method using a highly deviated injection well with production wells situated along the line of the injection well. This proposal has the disadvantages that not only is a relatively large number of production wells required but, in addition, correct positioning of these wells over the injection points is difficult.

Steam flooding processes using horizontal fractures for injecting the steam have been proposed in U.S. Pat. Nos. 3,375,870 and 4,265,310.

U.S. Pat. No. 4,466,485 describes a viscous oil recovery method which employs a steam injection well which extends through the formation in a horizontal direction. The production well is in the conventional vertical position and is completed in the upper two-thirds of the formation. A particular production cycle is employed to maximize recovery but because of the vertical disposition of the production wells, complete drainage of the formation is not assured.

SUMMARY OF THE INVENTION

According to the present invention, viscous oils are recovered from subterranean formations by a steam flooding operation using at least one horizontally drilled production well. The steam may be injected either through injection wells arranged vertically in the conventional manner, at an offset from the horizontal production well or, alternatively, a horizontal injection well may be used. Generally, it is preferred that the injection wells should be arranged along a line between two of the horizontal production wells in order to achieve maximum steam utilization and to optimize reservoir drainage into the production wells. The production wells will normally be situated near the bottom of the production interval to ensure that drainage is as complete as possible, thereby maximizing recovery.

DRAWINGS

DETAILED DESCRIPTION

Figure 1:
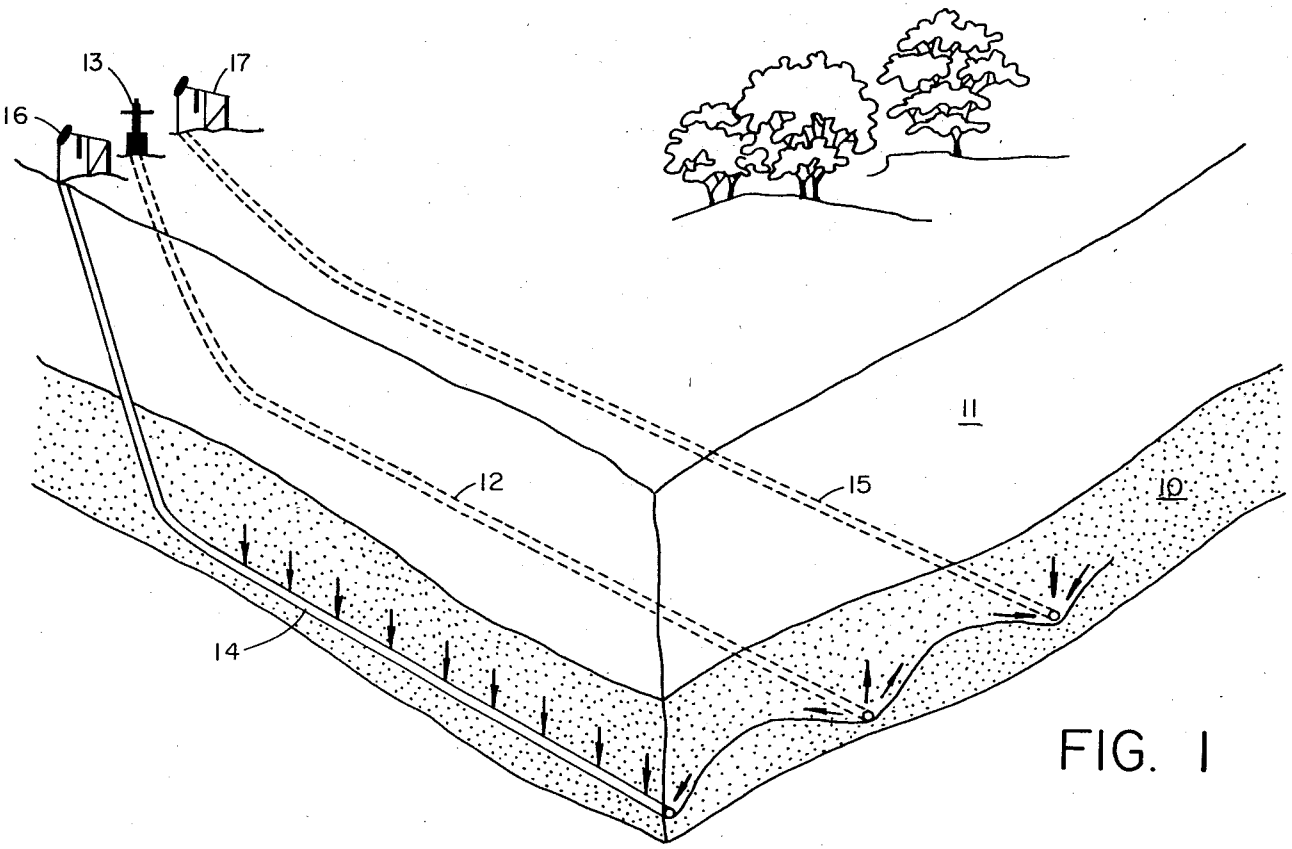
FIG. 1 is a simplified representation of a recovery operation using horizontal injection and production wells.

FIG. 1 shows the preferred well pattern for carrying out the present production method. A subterranean heavy oil formation 10 underneath an overburden 11 has a horizontal steam injection well 12 extending from surface injection head 13 in a substantially straight line along the bottom of the production interval. Two horizontal production wells 14, 15 also run through reservoir 10 at the bottom of the production interval, with their horizontal portions parallel to injection well 12. At the surface, the production wells are connected to suitable wellhead equipment 16, 17 for producing the fluids which enter the wells.

In operation, steam is injected into injection well 12 and thence into formation 10 where it heats the formation and the oil in place in the reservoir to the appropriate temperature for recovery through the production wells.

Figure 2:
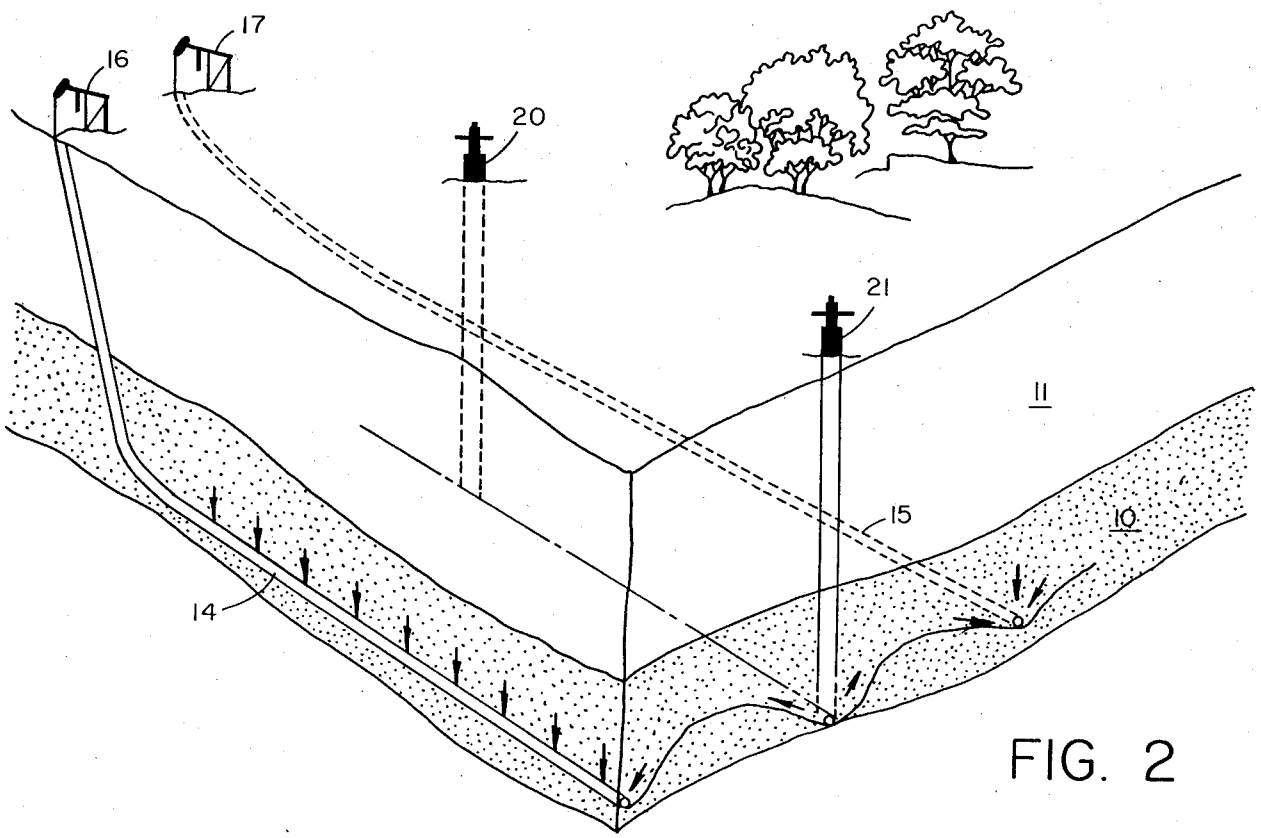
FIG. 2 is a simplified representation of a recovery operation using horizontal production wells and vertical injection wells.

An alternative arrangement is depicted in FIG. 2 in which vertical steam injection wells 20, 21 are disposed along a line parallel to and centrally between horizontal production wells 14, 15. The injector wells are completed at the bottom of the production interval and the horizontal production wells again, run along the bottom of the production interval. Wellhead equipment 16, 17 is provided as previously described.

Because the steam from the injector wells tends to rise in the reservoir after it leaves the injection well, the injection wells should preferably be completed in the lower portion of the production interval. However, to minimize heat losses to the non-pay zone beneath and to minimize channelling of steam under the pay zone, it may be desirable to position the horizontal injection well or to complete the vertical injection well, as appropriate, somewhat above the bottom of the production interval; e.g. at 80% or 90% of the vertical distance down the interval. Because the oil which has been heated by the steam will descend through the reservoir, taking with it some of the oil in place, positioning the injector at some distance up in the reservoir will not necessarily lose production because the descending, heated oil, together with entrained reservoir oil, will drain into the production wells at the bottom of the interval. Thus, the use of the horizontal producing wells establishes a vertical sweep of high efficiency in the reservoir. Area sweep may be up to almost 100 percent because of the greater reservoir area exposed to the producing wells.

The horizontal separation or offset between the line of injectors and the production wells needs to be chosen according to reservoir characteristics; e.g. nature of oil, matrix porosity, permeability and so forth. This may be determined by reference to the known characteristics of the reservoir prior to siting the wells. The well pattern may, of course, be repeated in order to cover the production field to the extent desired. Generally, it has been found that one horizontal well can replace about 2.5 to 3.8 vertical wells in a parallel horizontal injector/producer pattern, depending upon the vertical permeability of the formation; in a vertical injector/horizontal producer operation, one horizontal well can generally replace about 1.6 to 2.4 vertical producers. In an infinitely repeated vertical injector/horizontal parallel producer pattern, the injectors should be situated on the center line between the parallel producers with a separation equal to the separation between the producers. In this case, therefore, the number of vertical injectors between each pair of producers will be equal to the quotient of the length of the horizontal producers and their separation. The economics of the operation should therefore be considered at the outset since horizontal wells are more expensive to drill than vertical wells. The advantages of horizontal wells over vertical wells increase with an increasing ratio of vertical to horizontal permeability for the reservoir: as the ratio increases, residual oil saturation in the upper part of the reservoir will decrease, to give a better vertical sweep efficiency resulting from the improved drainage into the production wells.

Operating conditions for the steam flooding process should be chosen in accordance with known reservoir characteristics such as permeability, nature of oil and so forth. The operating procedure may follow conventional principles or may be adjusted suitably to take the greatest opportunity of exploting the advantages of the present invention. For example, steam injection rates may typically be from 1.5 to 2.0 barrels/day/acre-foot CWE (cold water equivalent) (from about 385 to 260 l./day/1000 $m^3$ CWE). Total amount of steam injected will depend primarily on reservoir thickness, temperature and thermal conductivity together with the characteristics of the oil; e.g. the extent to which it is affected physically and chemically by the steam. Typically, steam temperature will be from 200° to 400° C. (about 400° to 750° F.); temperatures at the higher end of this range will generally tend to promote cracking of the oil in the reservoir to produce a vis-broken oil of low viscosity which facilitates an enhanced degree of recovery of the reservoir oil, as compared to a non-visbroken oil that has merely been subjected to heating by lower temperature steam. Steam temperature is determined by its pressure of injection which, in turn, will depend upon the reservoir characteristics; e.g. reservoir pressure and can be readily determined. Steam quality may also be selected according to the desired amount of net heat to be injected but normally should lie between 0.4 to 0.8 for a safe and efficient operation of the steam generator.

The production operations may be run with either rate control or pressure control. In the former, a predetermined liquid flow rate is maintained by adjusting the bottomhole pressure at the injector. With pressure control, free flow of liquids is allowed by maintaining constant bottomhole pressure, assuming that pump capacity is adequate to remove all the fluids produced. Depending upon reservoir characteristics, it may be more advantageous to operate with rate control in order to achieve maximum production, although it may take longer to do it; the economics of the individual modes of operation should therefore be given appropriate consideration in each case.

Experimental

Vertical Well Pattern

Figure 3:
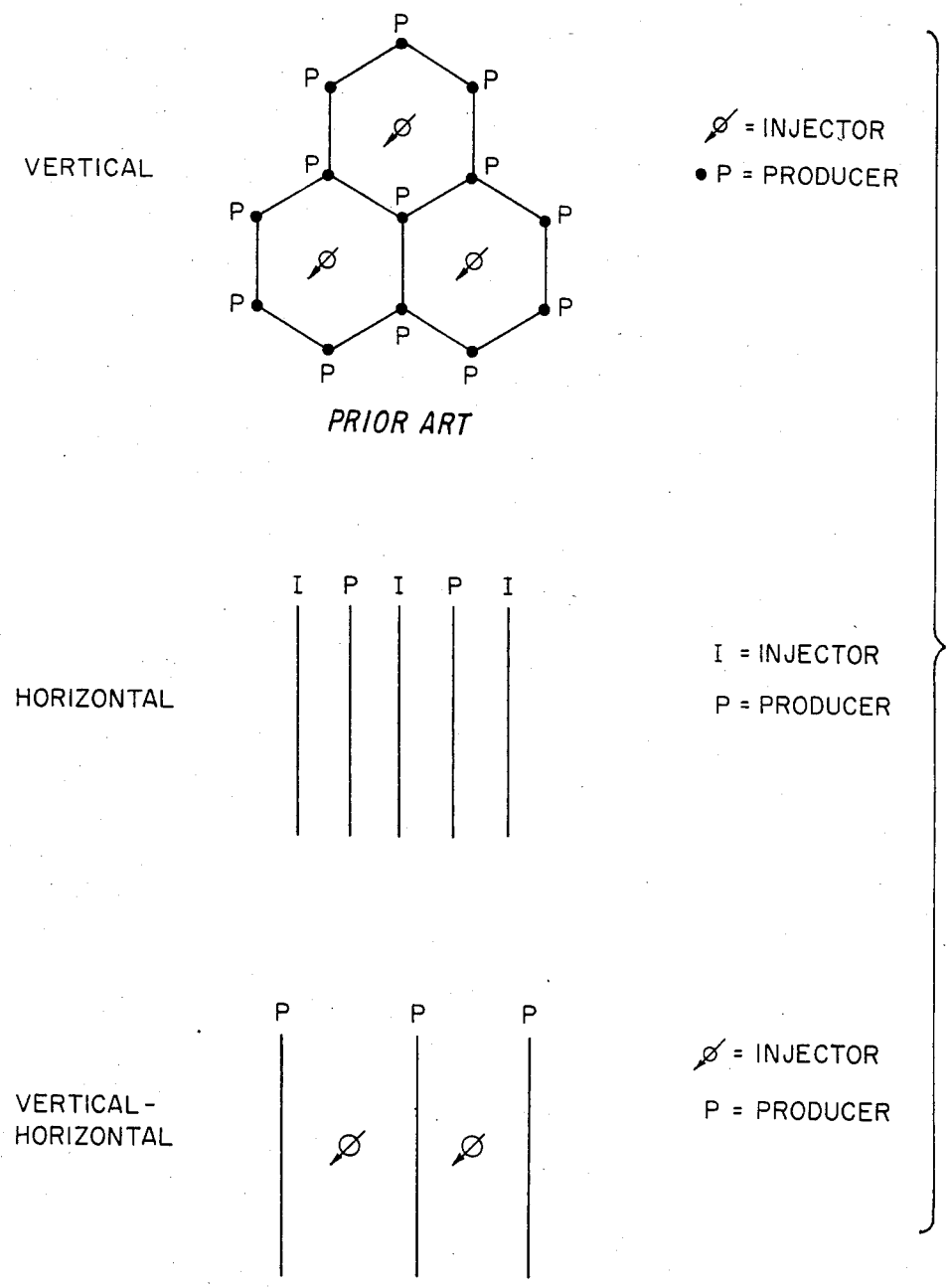
FIG. 3 is a schematic showing the well patterns used in the experimental simulations described below.

Using computer modelling techniques, a reservoir volume equivalent to about one-twelfth of an infinitely repeated seven spot vertical well pattern was simulated, as shown in FIG. 3. The model therefore assumed use of 1/12 of the injector and 1/6 of a producer. The equivalent area for the pattern was 6.9 acres (2.8 ha) thus giving a simulated area of 0.575 acre (0.23 ha), at a well distance of 341 ft (104 m).

The injector was completed in the 195 ft. (59 m) pay zone for an interval of 60 ft (18.3 m) and the producer 90 ft (27.4 m), each starting just above a 15 ft (4.6 m) water layer ($S_w$=0.81). Initial reservoir temperatures were 60° C. (140° F.) and 790 kPa (100 psig), respectively.

Steam of 60% quality was injected at 285° C. (545° F.) and 3200 kPa (450 psig), respectively, at an injection rate of 376 hl/day (237 bbl/day) for one-twelfth of an injector. The production well was placed on rate control with a maximum liquid rate of 477 hl/day (300 bbl/day), equivalent to 211 l/day/1000 $m^3$ (1.65 bbl/day/acre-foot).

Criteria used for determining the time of steam breakthrough were: live steam production, a significant drop in the oil production rate and a significant increase in the water:oil ratio (water:oil greater than 20:1).

Horizontal Well Pattern

A parallel horizontal well pattern, i.e., an infinitely repeated pattern of injectors and producers horizontal and parallel to one another, as shown in FIG. 3, of equivalent surface area to 1/6 of the vertical well pattern, using the same well separation of 104 m (341 ft). The resulting length of horizontal well simulated was therefore 45.3 m (148.5 ft). To cover an area equivalent to the entire seven spot vertical pattern, the horizontal wells would be six times as long, about 271 m (891 ft). The horizontal wells were placed 12 m (40 ft) from the bottom of the pay zone.

The injection of steam was stimulated using the same conditions as for the vertical well pattern.

For simulation purposes, the horizontal well pattern was tested with both rate control and pressure control.

Vertical-Horizontal Well Combination

An infinitely repeated well pattern having vertical injection wells and horizontal producers, as shown in FIG. 3, was also simulated. In this case, simulated area was equivalent to one quarter of the 7-spot vertical pattern, using a horizontal offset of 90 m (295 ft) between the vertical injector and the horizontal producer. The vertical well was completed for 18.3 m (60 ft) in the pay zone, as in the vertical well situation, and the horizontal well was situated 10.7 m (35 ft) above the water layer. The length of the horizontal well in the simulated area was about 152 m (500 ft).

Steam injection was simulated under the same conditions as for the other cases, using both rate and pressure control. The results are given in Table 1 below.

TABLE 1

Comparison of Well Patterns

| Pattern | Vertical | Horizontal | Vertical-Horizontal |
|---|---|---|---|
| Breakthrough Time, Days | 1470 | 1290 | 1290 |
| Injection, MBBL | 3862 | 3471 | 3672 |
| Production | | | |
| Oil, MBBL | 575.0 | 481.4 | 455.6 |
| Oil, % | 33.5 | 28.0 | 26.5 |

TABLE 1-continued

Comparison of Well Patterns

| Pattern | Vertical | Horizontal | Vertical-Horizontal |
|---|---|---|---|
| Water, MBBL | 4175.4 | 4053 | 4232 |
| Ratios | | | |
| Oil/Steam | 0.149 | 0.139 | 0.124 |
| Cumulative Water/Oil | 7.26 | 8.42 | 9.29 |

Notes:
(1) Injection and Production figures on equivalent 7-spot acreage basis.
(2) Percentage oil produced is percentage of original oil in place.
(3) Results for horizontal and vertical/horizontal patterns are on pressure control.

With the parallel horizontal well pattern under pressure control, breakthrough occurred, as shown in Table 1 at 1290 days. Under rate control, breakthrough occurred later (at 1470 days) but gave a higher total oil recovery, indicating that for the reservoir studied there is likely to be an optimum production rate between the cases considered in this study.

With the vertical/horizontal well pattern, a similar result was obtained in the comparison between rate and pressure control.

Figure 4:
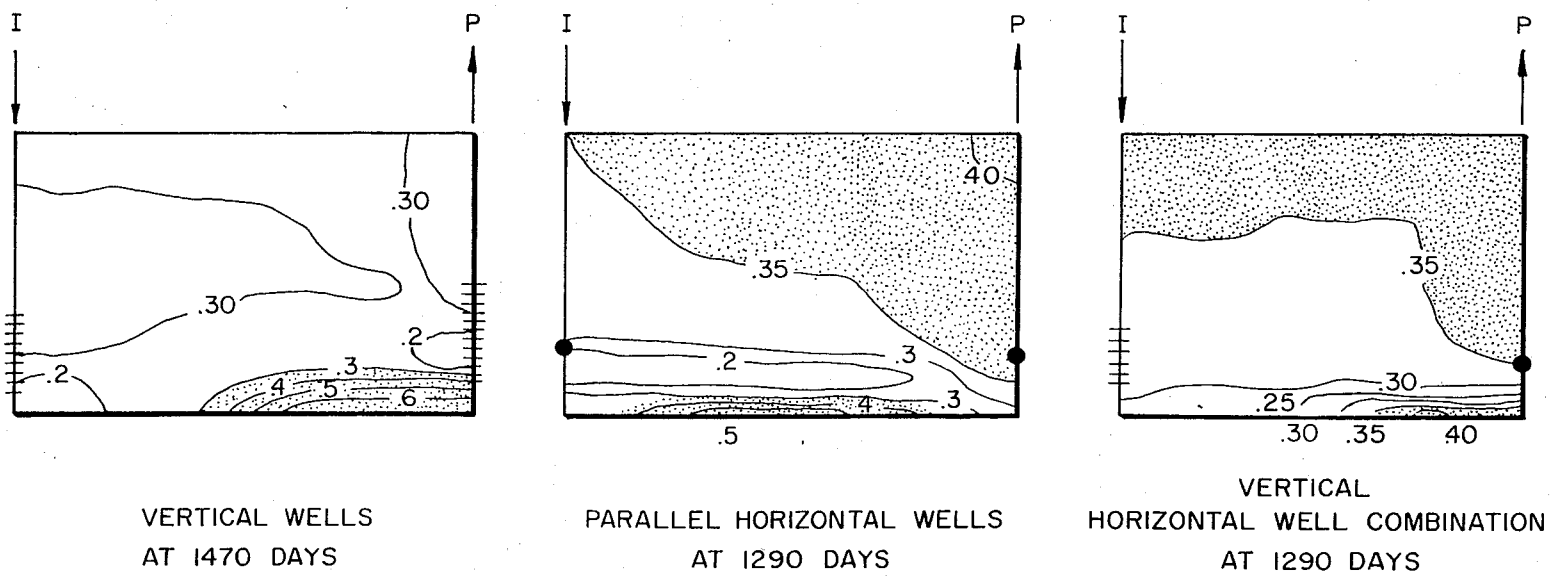
FIG. 4 is a comparison of the residual oil saturations obtained with the simulated production runs described below (vertical contours)
Figure 5:
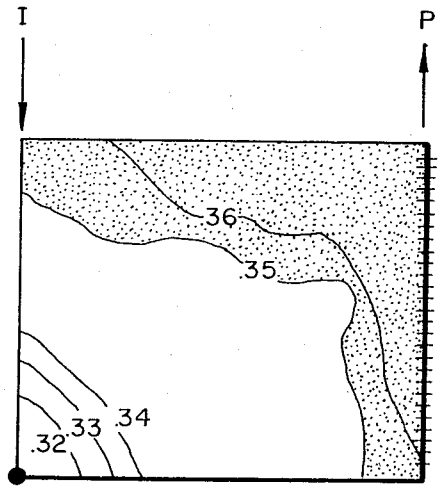
FIG. 5 is a comparison of the residual oil saturations obtained with the simulated production runs described below (horizontal contours).
Figure 5:
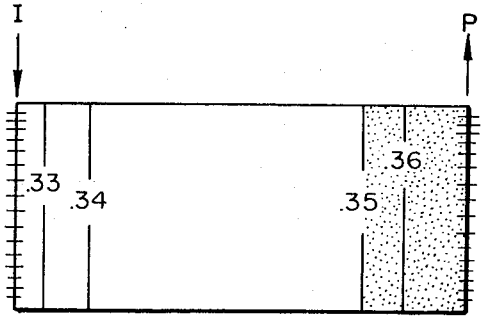
Figure 5:
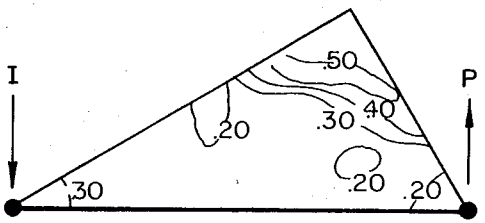

Comparison of the residual oil saturation contour plots at steam breakthrough shown in FIGS. 4 and 5 indicates that each type of well pattern has a different sweep pattern. FIG. 4 compares the oil saturation contours showing the vertical sweep in the plane which contained the vertical injector. All well patterns had poor vertical sweep in areas beneath the production well elevation. The vertical well pattern had excellent vertical sweep with steam overriding and pushing oil over and down to the producer. The parallel horizontal wells had less steam override and less recovery from the upper portion of the reservoir. The vertical-horizontal well combination showed an intermediate vertical sweep with more override near the vertical injector and less near the horizontal producer.

FIG. 5 illustrates the area sweep in the horizontal plane which contained the horizontal wells, at steam breakthrough. The vertical wells left some unswept oil between two producers in the 7-spot pattern. The area sweep of the horizontal wells is, of course, uniform for a two-dimensional simulation. The combination well pattern shows a somewhat intermediate area sweep. Steam front advance is very like plug flow in blocks directly between the vertical injector and the horizontal producers. It also shows a region of unswept oil in the corner opposite the vertical injector.

We claim:

1. In a method for the enhanced recovery of a viscous oil from a subterranean, oil-bearing formation by injecting steam into the formation through at least one injection well and producing oil from a plurality of separate producing wells situated at an offset from the injection well, the improvement which comprises (a) a plurality of substantially parallel horizontal production wells, and (b) a plurality of vertical injection wells located between each pair of adjacent parallel horizontal production wells and spaced apart along the center line between each of said pairs of parallel horizontal production wells at distances equal to the separation of said parallel horizontal production wells.

2. A method according to claim 1 in which the number of said plurality of vertical injection wells situated between each pair of adjacent parallel horizontal production wells is equal to the quotient of the length of said parallel wells and the separation between said production wells.

* * * * *